US009415361B2

(12) United States Patent
Gramann et al.

(10) Patent No.: US 9,415,361 B2
(45) Date of Patent: Aug. 16, 2016

(54) MIXER FOR MULTI-COMPONENT PASTES, KIT, AND METHOD OF MIXING PASTE COMPONENTS

(71) Applicant: 3M INNOVATIVE PROPERTIES COMPANY, St. Paul, MN (US)

(72) Inventors: Jens Gramann, Munich (DE); Ingo W. Wagner, Wörthsee (DE); Kai R. Huble, Starnberg (DE)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 869 days.

(21) Appl. No.: 13/680,778

(22) Filed: Nov. 19, 2012

(65) Prior Publication Data

US 2013/0077432 A1 Mar. 28, 2013

Related U.S. Application Data

(62) Division of application No. 11/575,763, filed as application No. PCT/EP2005/010156 on Sep. 21, 2005, now Pat. No. 8,322,909.

(30) Foreign Application Priority Data

Sep. 22, 2004 (EP) ..... 04022595

(51) Int. Cl.
*B01F 15/02* (2006.01)
*B01F 7/00* (2006.01)
*B01F 13/00* (2006.01)

(52) U.S. Cl.
CPC ..... *B01F 15/0274* (2013.01); *B01F 7/00775* (2013.01); *B01F 13/002* (2013.01); *B01F 15/0227* (2013.01); *B01F 2215/0027* (2013.01); *B01F 2215/0039* (2013.01)

(58) Field of Classification Search
CPC ..... B01F 2215/0039; B01F 2215/0027
USPC ..... 366/249, 331, 172.1
See application file for complete search history.

(56) References Cited

U.S. PATENT DOCUMENTS 2,816,518 A 12/1957 Daggett
3,051,455 A 8/1962 Magester
(Continued)

FOREIGN PATENT DOCUMENTS

DE 30 31 939 4/1982
DE 32 33 366 9/1983
(Continued)

OTHER PUBLICATIONS

Brochure entitled "Mixer (light-blue)—Mischer (hellblau)" from MIXPAC Systems AG (2 pgs.) dated Oct. 24, 1997.
(Continued)

*Primary Examiner* — Charles Cooley
*Assistant Examiner* — Marc C Howell

(57) ABSTRACT

The present invention provides a mixer for producing a past by mixing components. The mixer includes a housing having a longitudinal axis, a rear end, and a front end provided with a discharge opening. The mixer also includes a mixing changer formed in the housing, where the mixing chamber has an entry side facing the rear end of the housing. The initial content of the mixing chamber is diverted from the discharge opening, and the subsequent content of the mixing chamber is extrudable from the discharge opening.

10 Claims, 13 Drawing Sheets

(56) References Cited

U.S. PATENT DOCUMENTS

| | | | | |
|---|---|---|---|---|
| 3,226,093 | A | 12/1965 | Gugel et al. | |
| 3,286,992 | A * | 11/1966 | Armeniades | B01F 5/0615 138/42 |
| 3,302,832 | A | 2/1967 | Hardman et al. | |
| 3,390,814 | A | 7/1968 | Creighton, Jr. et al. | |
| 3,570,716 | A | 3/1971 | Kirsanoff et al. | |
| 3,570,719 | A | 3/1971 | Schiff | |
| 3,587,982 | A | 6/1971 | Campbell | |
| 3,606,094 | A | 9/1971 | Mills et al. | |
| 3,767,085 | A | 10/1973 | Cannon et al. | |
| 3,774,809 | A | 11/1973 | Bratton | |
| 4,107,793 | A | 8/1978 | Wallace | |
| 4,408,890 | A | 10/1983 | Beckmann | |
| 4,432,469 | A | 2/1984 | Eble et al. | |
| 4,469,153 | A | 9/1984 | Morrisette | |
| 4,471,888 | A | 9/1984 | Herb et al. | |
| 4,538,920 | A | 9/1985 | Drake | |
| 4,566,610 | A | 1/1986 | Herb | |
| 4,767,025 | A | 8/1988 | Gebauer et al. | |
| 4,767,026 | A | 8/1988 | Keller et al. | |
| 4,771,919 | A | 9/1988 | Ernst | |
| 4,871,090 | A | 10/1989 | Hoffmann | |
| 4,889,432 | A * | 12/1989 | Patterson | A61C 5/064 222/388 |
| 4,934,827 | A | 6/1990 | Taschke et al. | |
| 4,951,843 | A | 8/1990 | Paetow | |
| 4,995,540 | A | 2/1991 | Colin et al. | |
| 5,033,650 | A | 7/1991 | Colin et al. | |
| 5,064,098 | A | 11/1991 | Hutter, III et al. | |
| 5,080,262 | A | 1/1992 | Herold et al. | |
| 5,186,363 | A | 2/1993 | Haynes | |
| 5,237,000 | A | 8/1993 | Lausberg et al. | |
| 5,249,709 | A | 10/1993 | Duckworth et al. | |
| 5,249,862 | A | 10/1993 | Herold et al. | |
| 5,332,122 | A | 7/1994 | Herold et al. | |
| 5,419,460 | A | 5/1995 | Herold et al. | |
| 5,421,650 | A | 6/1995 | Meyer | |
| 5,487,606 | A | 1/1996 | Keller | |
| 5,493,078 | A | 2/1996 | Uchiike | |
| 5,498,078 | A | 3/1996 | Keller | |
| 6,115,935 | A | 9/2000 | Collins et al. | |
| 6,129,244 | A | 10/2000 | Hörth | |
| 6,135,631 | A | 10/2000 | Keller | |
| 6,161,730 | A | 12/2000 | Heusser et al. | |
| 6,186,363 | B1 | 2/2001 | Keller et al. | |
| 6,224,740 | B1 | 5/2001 | Gestermann et al. | |
| 6,244,740 | B1 | 6/2001 | Wagner et al. | |
| 6,311,871 | B1 | 11/2001 | Binder | |
| 6,321,945 | B1 | 11/2001 | Girouard et al. | |
| 6,328,182 | B1 | 12/2001 | Brugner | |
| 6,352,177 | B1 | 3/2002 | Bublewitz et al. | |
| 6,394,314 | B1 | 5/2002 | Sawhney et al. | |
| 6,394,643 | B1 | 5/2002 | Bublewitz et al. | |
| 6,435,707 | B1 * | 8/2002 | Mori | B01F 7/166 366/171.1 |
| 6,443,612 | B1 | 9/2002 | Keller | |
| 6,457,609 | B1 | 10/2002 | Keller | |
| 6,523,992 | B1 | 2/2003 | Bublewitz et al. | |
| 6,527,203 | B2 | 3/2003 | Hurray et al. | |
| 6,530,685 | B1 | 3/2003 | Mühlbauer et al. | |
| 6,540,395 | B2 | 4/2003 | Mühlbauer et al. | |
| 6,620,125 | B1 | 9/2003 | Redl | |
| 6,769,574 | B1 | 8/2004 | Keller | |
| 6,820,766 | B2 | 11/2004 | Keller et al. | |
| 6,837,399 | B1 | 1/2005 | Wagner et al. | |
| 6,837,612 | B2 | 1/2005 | Bublewitz et al. | |
| 6,854,621 | B2 | 2/2005 | Keller | |
| 6,932,243 | B2 | 8/2005 | Keller | |
| 6,981,621 | B2 | 1/2006 | Brandeis | |
| 7,287,898 | B2 | 10/2007 | Pauser et al. | |
| 7,316,330 | B2 | 1/2008 | Muller et al. | |
| 7,320,541 | B2 | 1/2008 | Wagner et al. | |
| 7,367,475 | B2 | 5/2008 | Horth et al. | |
| 7,383,969 | B2 | 6/2008 | Horth et al. | |
| 7,387,432 | B2 | 6/2008 | Lu et al. | |
| 7,674,033 | B2 | 3/2010 | Pauser | |
| 7,694,412 | B2 | 4/2010 | Absalonson | |
| 7,806,297 | B2 | 10/2010 | Pauser | |
| 8,020,728 | B2 | 9/2011 | Suchan | |
| 8,028,859 | B2 | 10/2011 | Paetow | |
| 8,033,429 | B2 | 10/2011 | Keller | |
| 8,286,832 | B2 | 10/2012 | Keller | |
| 8,322,909 | B2 | 12/2012 | Gramann | |
| 2003/0137898 | A1 | 7/2003 | Wagner et al. | |
| 2004/0085854 | A1 * | 5/2004 | Pauser | B01F 15/0201 366/172.1 |
| 2004/0357909 | | 12/2004 | Pieroni | |
| 2005/0035153 | A1 | 2/2005 | Brown | |
| 2005/0205606 | A1 | 9/2005 | Nehren et al. | |
| 2005/0232073 | A1 | 10/2005 | Wagner et al. | |
| 2008/0029542 | A1 | 2/2008 | Keller | |
| 2008/0087683 | A1 | 4/2008 | Wagner et al. | |
| 2013/0077432 | A1 | 3/2013 | Gramann | |

FOREIGN PATENT DOCUMENTS

| | | |
|---|---|---|
| DE | 32 37 353 | 4/1984 |
| DE | 33 03 667 | 8/1984 |
| DE | 36 06 001 | 8/1987 |
| DE | 89 00 409.4 | 4/1989 |
| DE | 38 38 593 | 5/1990 |
| DE | 40 26 685 | 2/1992 |
| DE | 42 12 863 | 10/1992 |
| DE | 93 14 012.6 | 9/1993 |
| DE | 42 35 736 | 3/1994 |
| DE | 43 09 798 | 9/1994 |
| DE | 94 12 703.4 | 10/1994 |
| DE | 94 11 665.2 | 1/1995 |
| DE | 100 15 133 | 3/2000 |
| DE | 298 18 499 | 4/2000 |
| DE | 299 02 666 | 8/2000 |
| DE | 100 43 489 | 9/2000 |
| DE | 101 64 385 | 3/2003 |
| DE | 10 2004 008 748 | 9/2004 |
| EP | 0 232 733 | 8/1987 |
| EP | 0 328 936 | 2/1989 |
| EP | 0 472 448 | 7/1991 |
| EP | 0 885 651 | 12/1998 |
| EP | 1 099 470 | 5/2001 |
| EP | 1 106 243 | 6/2001 |
| EP | 0 971 787 | 8/2002 |
| EP | 1 029 585 | 4/2003 |
| EP | 1 149 627 | 8/2004 |
| JP | 6-226178 | 8/1994 |
| JP | 8-187727 | 7/1996 |
| WO | WO 83/02712 | 8/1983 |
| WO | WO 93/14863 | 8/1993 |
| WO | WO 94/23294 | 10/1994 |
| WO | WO 98/43727 | 10/1998 |
| WO | WO 02/074426 | 9/2002 |
| WO | WO 03/055582 | 7/2003 |

OTHER PUBLICATIONS

Lomberg GmbH & Co., DMG Hamburg, "Innovationen & Mehr," 1998-1999, 14 pages.

* cited by examiner

MIXER FOR MULTI-COMPONENT PASTES, KIT, AND METHOD OF MIXING PASTE COMPONENTS

CROSS-REFERENCE TO RELATED APPLICATIONS

The application is a divisional of U.S. application Ser. No. 11/575,763, filed Mar. 11, 2008, now allowed, which is a national stage filing under 35 U.S.C. 371 of PCT/EP2005/010156, filed Sep. 21, 2005, which claims priority to European Patent Application No. 04022595.5, filed Sep. 22, 2004, abandoned, the disclosures of which are incorporated by reference in their entirety herein.

FIELD OF THE INVENTION

The present invention relates to a mixer for multi-component pastes, a kit comprising at least one mixer, and a method of mixing paste components.

BACKGROUND OF THE INVENTION

Pasty multi-component masses, such as dental impression masses, are prepared by mixing devices in which the individual components of the mass are simultaneously supplied from separate cartridge cylinders to a mixer which dispenses the mixed paste from a front end. The mixer may be a static mixer or a dynamic mixer (having a rotary mixer element). The paste exiting from the front end of the mixer may be supplied directly onto an impression spoon or tray.

Examples of dynamic mixers are found in, e.g., WO 00/21652, EP-A-1 149 627, U.S. Pat. No. 5,249,862 or DE-U-297 05 741. These known dynamic mixers have as their rear end (inlet side) a central hexagonal opening for coupling to a drive shaft for rotating the inner body of the mixer, and further two additional inlet connectors for feeding the components which are to be mixed.

Depending on the viscosity and mixing ratio, the fact that the pressure builds up differently in the individual cartridge cylinders at the start of the device may cause the components to reach the mixer at different times. In such a case, the initial volume of paste exiting from the mixer has a mixing ratio which differs from a desired value and may therefore cure less perfectly or more slowly, or have other undesired properties.

U.S. Pat. No. 6,244,740 suggests a mixer for producing multi-component pastes. This dynamic mixer contains a deviating channel provided between the inlet opening for the component of the larger volume proportion and the mixing chamber, in order to delay the feed of this component with respect to the other component. Typically, the flow of the base paste is thus delayed compared to the flow of the catalyst.

US-A-2004/085854 describes a dynamic mixer having a delay chamber provided between the inlet opening for the component of the larger volume proportion and the mixing chamber, in order to delay the feed of this component with respect to the other component. The delay chamber has, inter alia, a boundary wall located in the flow direction of a paste component, on which the paste component backs up. The delay chamber also has at least one opening, which opens into the mixing chamber and which is arranged to be set back with respect to the boundary wall. The term set back in the sense of this invention is to be understood to mean an arrangement in which the opening does not adjoin the boundary wall directly but is arranged offset from the latter (see paragraphs [0040] and [0041]). The component flows into the mixing chamber only after the delay chamber is filled.

Mixers having channels of different lengths between the inlet openings of the mixer and the mixing chamber are described, e.g., in DE-U-203 02 987, U.S. Pat. No. 6,523,992, and US-A-2003/123323.

Further improvements in the mixing and dispensation of a mixed paste having a desired ratio of first and second components would be desirable.

SUMMARY OF THE INVENTION

In general, the present invention provides a mixer for producing a paste by mixing components. The mixer comprises a housing having a longitudinal axis, a rear end, and a front end provided with a discharge opening, and a mixing chamber formed in said housing and having an entry side facing the rear end of said housing, wherein the initial content of the mixing chamber is diverted from the discharge opening, and the subsequent content of the mixing chamber is extrudable from the discharge opening. The initial content is preferably permanently diverted.

Preferably, the mixer comprises a reservoir for permanently storing the initial content of the mixing chamber. More preferably, the mixer is configured such that when the initial content of the mixing chamber fills the reservoir, the subsequent content of the mixing chamber is extrudable through the discharge opening. Preferably, the reservoir preferably permanently stores the initial content of the mixing chamber.

Preferably, a mixing element is provided in said mixing chamber. Alternatively, the mixing chamber comprises projections extending from the wall of the housing.

The reservoir of the mixer according to the present invention is arranged such that it stores the initial content of the mixing chamber. The initial content of the mixing chamber is the first amount of material entering the mixing chamber from the dispensing cartridge, for example a base paste and/or a catalyst. In storing the initial material entering the mixing chamber, it is avoided that a mixture has an undesirable mixing ratio, i.e. contains too much of one of the components to be mixed. If the initial amount entering the mixer is stored in said reservoir, it substantially does not contaminate the mixing chamber. The mixing only starts after the reservoir is filled. At that point, all components to be mixed have entered the mixer so that the preparation of a desirable, balanced mixture is guaranteed.

Alternatively, the initial content of the mixing chamber is the initial amount of mixture being prepared in the mixing chamber. If the components to be mixed initially enter the mixing chamber at an undesired ratio, the initial mixture would not comprise the desirable mixing ratio. Thus, the initial amount of mixture is stored in the reservoir and is not dispensed from the mixer. This amount of mixture is discarded with the mixer after use. Hence, the user is prevented from using the first amount of mixture potentially having an undesirable mixing ratio.

Thus, in accordance with the present invention, the initial amount of material entering the mixing chamber from the dispensing cartridge or the initial amount of mixture being prepared in the mixing chamber is diverted from the discharge opening. This is in clear contrast to, for example, US 2003/123323, and U.S. Pat. No. 6,244,740 discussed above. According to US 2003/123323, the two ducts being provided upstream of the mixing chamber are formed so that the first duct requires a greater time of entry of the compound into the mixing chamber than the time required for the second component flowing through the second duct. U.S. Pat. No. 6,244, 740 describes having a channel upstream of the mixing chamber to delay feed of one component with respect to the other component.

Several advantages are related to the present invention.

Since the first amount of mixture that is dispensable already comprises the desirable mixing ratio, the characteristics of the mixture should be more reliably present from the start. Furthermore, there is no color change of the impression material during the whole mixing process. Furthermore, it is of no concern whether there is initially more catalyst or more base paste entering the mixing chamber. At present, the foil bag for the dispensing cartridge containing the catalyst is filled up to 105% of the volume required with respect to the total amount of base paste, to reduce the likelihood that an amount of mixture comprises too little catalyst. With the present invention, this additional amount can be reduced or even eliminated. Finally, there is significant lower pressure loss in the mixer since the components do not have to flow through any kind of delay channel prior to entering the mixing chamber.

The rear end of the housing of the mixer is formed by a terminating plate, comprising separate inlet pipes adapted for connection with a dispensing cartridge containing the components. Preferably, the reservoir is located downstream of the terminating plate.

According to a first aspect of the present invention, the mixer comprises a reservoir which is adapted for filling in the longitudinal direction of the mixer. In other words, the reservoir of this aspect of the present invention is fillable or filled in an axial direction. That is, in the context of the present invention "axial" always refers to the longitudinal axis, and "radial" refers to a direction perpendicular to the longitudinal axis.

According to a first embodiment of the first aspect of the present invention, the reservoir is located at the front end of the housing.

It is preferred that the housing comprising a tubular element along the longitudinal axis of the mixer, i.e. concentric with the longitudinal axis. The tubular element furthermore projects from the discharge opening inwards into said mixing chamber. With such structure, the tubular element forms at the front end of the housing an annular reservoir between the outer surface of the tubular element and the inner surface of the housing.

In order to facilitate the flow of the mixture into the reservoir before it is dispensed from the mixer, and to ensure that the initial mixture is not dispensed but stored in the reservoir, the mixture further preferably comprises a baffle downstream of the front end of the mixing element. That means, the baffle is provided between the mixing element and the dispensing opening, such as the tubular element. According to the first embodiment of the first aspect of the present invention, the baffle comprises a circular plate in a plane transverse to the longitudinal axis of the mixer and at least one connection connecting the baffle plate to the wall of the housing. Preferably, the connection is in the plane of the baffle plate. Preferably, three connections are provided spaced from each other at 120° to connect the baffle plate with the housing.

Alternatively, according to another embodiment of the first aspect of the present invention, the baffle comprises a circular plate in a plane transverse to the longitudinal axis of the mixer and at least one connection connecting the plate to the tubular element. For example, the at least one connection is arranged to bridge the gap between the baffle plate and the tubular element, for example perpendicular to the plane of the baffle plate to connect the same to the tubular element. Preferably, the connections form extensions of the tubular element that bridge the gap between the rear end of the tubular element and the baffle plate. The plate preferably comprises a recess for receiving the front end of said mixing element, thus serving as a front end socket for the mixing element.

According to a further embodiment of the first aspect, the baffle is connected to the front end of the mixing element or an integral part of the mixing element. In this case, the baffle is for example a circular plate or a cone or a truncated cone being located at the tip of the mixing element. In case of a cone/truncated cone, the cone or truncated cone is connected with its peak to the front end of said mixing element. Thus, the diameter of the cone increases towards the dispensing opening which automatically deflects the flow of the mixture towards the reservoir.

In any case, the baffle plate preferably has a surface area that is large enough to prevent the initial mixture from directly reaching the dispensing opening. More preferably, the cross-sectional area corresponds to the cross-sectional area of the tubular element and/or dispensing opening.

According to a further alternative embodiment of the first aspect of the present invention, the mixer comprises a baffle located between the mixing element and the front end of the housing, and the baffle comprises a circular plate in a plane transverse to the longitudinal axis of the mixer and at least one connection connecting the plate to the wall of the housing, wherein in this embodiment the baffle further comprises a tubular wall extending from the plate along the longitudinal axis and towards the rear end of said housing. Thus, a cavity is formed on the baffle plate by the tubular wall. This cavity is open towards the mixing element so that it forms the reservoir that receives and stores the initial amount of the mixture.

In this embodiment, it is preferred that the housing comprises a first section having a first diameter, and a second section having a second diameter, wherein the second diameter is greater than the first diameter, and the second section is located downstream of the first section. The first and second sections are connected by a flange. The baffle is arranged within the second section of the housing. Furthermore, the tubular wall has preferably the same or a larger diameter as the first section of the housing. This assists in the storing of the initial mixture in the reservoir. After the reservoir is filled, the "overflow" flows around the tubular wall and baffle plate, and reaches the dispensing opening.

The mixer of a further embodiment of the first aspect of the present invention comprises a wall opening in the circumferential wall of the housing. This wall opening is located in the front end area of the housing and is also offset from the front end wall of said housing towards the rear end of the housing. In other words, the wall opening is not located at the tip of the mixer but is set back some distance. Furthermore, a deviating channel extends from the wall opening and terminates in a discharge opening such that the discharge opening is offset from said longitudinal axis. In this embodiment, the dispensing opening is not located on the longitudinal axis of the mixer at the mixer tip but eccentrically located at the end of the deviating channel. In this case, since the tip of the mixer is closed, a reservoir is formed at the tip. This reservoir stores the initial mixture until the level of the mixture in the reservoir reaches the wall opening. The material flow is then through the deviating channel to the dispensing opening.

A second aspect of the present invention makes use of gravitational force to store material in a reservoir.

The basic structure of the mixer according to an embodiment of the second aspect of the present invention is identical to that of the first aspect. However, it further comprises a wall opening in the circumferential wall of the housing, and a closed channel extending from the wall opening to the outside away from the wall of the housing. This closed channel forms a cavity which receives and stores the initial mixture. Preferably, the wall opening is arranged in a front end area of the housing. It is further preferred that the closed channel comprises an axis, wherein the axis of the closed channel is inclined relative to the longitudinal axis of the mixer. In other words, the channel branches off from the mixing chamber. The angle of inclination is preferably such that when the mixer is in use, the closed channel is oriented vertically with its opening at the top so that the initial mixture can easily enter the reservoir simply due to gravitation.

According to the third aspect of the present invention, the mixer comprises a reservoir which is adapted for filling along the longitudinal axis of the mixer. In other words, the reservoir of this aspect of the present invention is fillable or filled in an axial direction. This is identical to the first aspect. However, according to the third aspect, the reservoir is located at the rear end of the mixer.

A mixer according to an embodiment of the third aspect of the present invention comprises a housing that comprises a main section having a first diameter along its length and a first rear end and a first front end, and a second section having second rear end and a second front end. The diameter of the second section at least at the second rear end is greater than the first diameter. The second rear end of the second section forms the rear end of the housing, the first rear end is inwardly offset along the longitudinal axis from the rear end of the housing, and the second front end of the second section is connected to the main section in a circumferential area being offset from the first rear end towards the first front end of the main section. Preferably, the second section comprises a stepped configuration. Alternatively, the second section comprises the configuration of a truncated cone.

It is further preferred in this embodiment that an annular passageway is formed between the first rear end of the main section and the second section, allowing material flow from the second section into the main section. The interior of the main section forms the mixing chamber.

In the third aspect of the present invention, a reservoir is formed at the rear end of the mixer. Thus, the reservoir receives and stores the initial amount of the components entering the mixing chamber. Once the reservoir is filled with the initial amount of the components, the flow of the components is directed to the mixing chamber. The annular reservoir formed by the different sections of the housing having different diameters and rear ends being offset from each other in a longitudinal direction is preferably located underneath the inlet pipes of the terminating plate so that the initial component amounts are forced to first fill the reservoir before being mixed with each other.

According to a fourth aspect of the present invention, the reservoir is adapted for radial filling, in particular at the rear end of the housing.

The mixer of a first embodiment of the fourth aspect of the present invention has a housing that comprises at least one passageway through its circumferential wall. More preferably, the housing comprises a plurality of passageways through its circumferential wall being separated from each other by webs. According to this embodiment, the mixer further comprises at least one wall structure forming a cavity covering the at least one passageway on the outer surface of said housing. Preferably, the wall structure annularly surrounds said housing.

According to one alternative embodiment the at least one passageway is arranged in a rear end area of said housing. Alternatively, which is according to a fifth aspect of the present invention, the at least one passageway is arranged in a middle area of said housing between said front end and said rear end.

The wall structure preferably comprises a tubular section having a diameter that is greater than the diameter of the housing, and at least one flange section connecting the tubular section to the wall of the housing.

According to a further embodiment of the fourth aspect, the housing of the mixer comprises a main section having a first diameter and an area of increasing diameter between the main section and the rear end of the housing. The mixing element comprises a funnel-shaped element which is arranged at the rear end of the mixing element and rearwards of the main housing section. The diameter of the funnel-shaped element decreases from its rearmost end to the other end where it is connected to the shaft of the mixing element. The funnel-shaped element preferably is in the form of a truncated cone. The funnel-shaped element comprises at least one passageway at its frontmost end extending along the longitudinal axis of the mixer.

The funnel-shaped element defines an opening at its rearmost end having a diameter such that the components enter the mixer within the opening of the funnel-shaped element. In other words, the diameter is large enough to span the inlet pipes of the terminating plate of the mixer.

Preferably, the connection between the funnel-shaped element and the shaft of the mixing element is located rearwards from the rear end of the main section of the housing thus forming a annular cavity between the funnel-shaped element and the area of the housing having an increasing diameter. This annular cavity forms the reservoir receiving and storing the initial amounts of components entering the mixer.

In order to compensate for the axial forces acting on the mixing element due to the fact that the material flow of the components is first guided by the funnel-shaped element once the components have entered the mixer, the mixer preferably comprises a bearing-like or socket-like structure for the front end of the mixing element.

In order to enhance the radial material flow into the reservoir, the mixing element further comprises at least one paddle for deflecting the (axial) material flow into the reservoir. The at least one paddle is arranged at the mixing element at a longitudinal position corresponding to the longitudinal position of the reservoir, i.e. at the same level.

According to first embodiment of the sixth aspect of the invention, the shaft of the mixing element comprises a cavity and at least one passageway connecting the cavity with the mixing chamber. Preferably, the shaft is hollow along a substantial length thereof. Further preferably, the passageway is arranged at a rear end of said mixing element. This ensures that the initial amount of components does not contaminate the mixing chamber but is stored in the hollow shaft of the mixing element.

The mixer of a seventh aspect of the present invention comprises at the shaft of the mixing element a rearwardly-directed, L-shaped circumferential flange. The flange is located adjacent to the rear end of the mixing element. Because the L-shaped flange is open towards the rear end, a reservoir is formed. Since this flange is located at the rear end of the shaft, the initial amount of the components are stored in the reservoir and do not substantially contaminate the mixing chamber. Alternatively, the L-shaped flange can be located further downstream to store the initial amount of the mixture.

It is preferred in all aspects of the present invention that the mixing element comprises mixing vanes or mixing blades. Furthermore, the mixing element is preferably rotatable about the longitudinal axis of the mixer and comprises a hexagonal opening at its rear end connectable to the drive shaft of a dispensing apparatus. Alternatively, structures extending from a wall could form mixing vanes or blades if desired, or a combination of fixed vanes and moving vanes could be provided.

The present invention thus encompasses a mixer in which either a portion of the mixed material can be diverted, or portions of each of the unmixed material can be diverted individually (either to separate reservoirs or to a single reservoir).

The present invention also encompasses combinations of the aspects of the present invention. For example, the present invention encompasses the combination of a reservoir at the front end of the housing that is radially filled and a hollow shaft of the mixing element providing an additional reservoir.

The present invention also encompasses a kit comprising a dispensing cartridge and at least one mixer according to any of the aspects of the present invention.

The present invention also encompasses a kit comprising at least one of a first container and at least one of a second container, said first and second container containing the paste components to be mixed, and at least one mixer according to any of the aspects of the present invention.

Furthermore, the present invention also encompasses a method of mixing at least two paste components, said method comprising the steps of: a) discharging said paste components from a dispensing apparatus by using delivery pistons; b) introducing said components into a mixer being connected to said dispensing apparatus, said mixer having a mixing chamber; c) mixing said components; and d) discharging the mixture of said components from said dispensing apparatus; wherein said initial contents of said mixing chamber are stored therein before subsequent contents of said mixing chamber are discharged.

The invention will now be described with reference to the accompanying drawings.

DETAILED DESCRIPTION OF A PREFERRED EMBODIMENT

Figure 1:
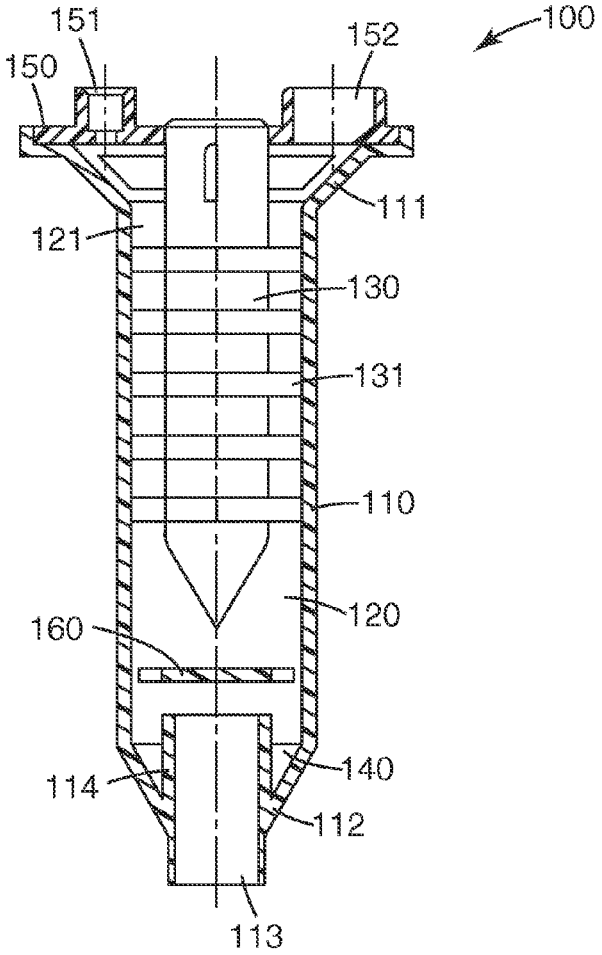
FIG. 1 is a longitudinal view of a first embodiment of the mixer according to a first aspect of the present invention, having a reservoir at the front end of the mixer.

The mixer 100 according to a first embodiment of the present aspect of the present invention is shown in FIG. 1. It includes a housing 110 which has a mixing chamber 120 which is cylindrical throughout its principal part. The housing 110 has a longitudinal axis, a rear end 111 and a front end 112. The mixing chamber 120 has an entry side 121 facing said rear end 111 of said housing 110. At the rear end 111, the housing 110 is formed by a terminating plate 150 forming the rear wall of the housing 110. Furthermore, the mixer 100 shown in FIG. 1 comprises a mixer element 130 supported by the housing 110, in particular by the terminating plate 150. A hexagonal opening (not shown in FIG. 1) is provided at the rear end of the mixer element 130 for coupling to a drive shaft (not shown). The mixer element 130 is supported within the housing 110 for rotation about the longitudinal axis of the mixer element 130.

The terminating plate 150 has two rearwardly extending inlet pipes 151, 152, by which the mixer 100 may be coupled to the front end of a cartridge placed in a dispensing apparatus (not shown). In the embodiment illustrated, the mixer 100 is assumed to be adapted for producing a dental impression mass which is mixed, for example, from a pasty base substance and a catalyst substance at a specific ratio. To this end, the inlet pipe 151 and the inlet pipe 152 for the base substance and for the catalyst, respectively, have a cross-section area that provides the desired mixing ratio.

The two rearwardly projecting inlet pipes 151, 152 are integrally formed with the terminating plate 150 at positions off-set from the center bore. Preferably, the inlet pipes are positioned opposite to each other with regard to the center axis. The inlet pipes are adapted for being directly inserted into outlet openings of cartridges which contain the components to be mixed. Preferably, the outer surfaces of the pipe sockets are conically formed (with a rearward taper) to provide a sufficient seal between the inlet pipes and the outlet openings of the cartridges.

In FIG. 1, the inlet pipes are shown with different internal cross-sections to illustrate a case in which two components are to be mixed at a ratio different from 1:1.

At the front end 112 of the mixer 100, a discharge opening 113 is provided for dispensing the mixed paste.

In a preferred embodiment, the mixer identified by numeral 100 consists of three molded synthetic resin parts, namely the housing 110, the terminating plate 150 and the mixing element 130.

The mixing element 130 comprises a shaft extending along the longitudinal axis of the mixing element 130. A plurality of mixing vanes or blades 131 are located along the shaft as known in the art. Preferably, the mixing vanes are integrally formed on the outer surface of the shaft of the mixing element 130. As shown in FIG. 1, the mixing vanes 131 are provided within the cylindrical portion of the mixing chamber 120 and end short of the internal chamber wall.

This basic preferred structure is common to various aspects of the present invention.

FIG. 1 is a longitudinal view of a first embodiment of the mixer according to a first aspect of the present invention. In this embodiment, the mixer comprises a reservoir 140 at the front end 112 of the mixer 100. The housing 110 of the mixer 100 of this embodiment comprises a tubular element 114. This tubular element 114 projects from the discharge opening 113 inwards into the mixing chamber 120. Due to this tubular projection, an annular reservoir 140 is formed around the tubular element 114. With such an annular reservoir surrounding the discharge opening 113, the initial mixture is stored within the mixing chamber 120 and is not discharged through the discharge opening 113. However, in order to insure that the initial mixture is indeed stored in the annular reservoir 140, a baffle plate 160 is preferably provided between the tubular element 114 and the tip of the mixing element 130. This baffle plate 160 deflects the flow of the mixture. In more detail, the mixture has to flow around the baffle plate 160 and is thus guided along the inner wall of the housing 110 into the reservoir 140. Only when the reservoir 140 is filled will the mixture pass through the discharge opening 130 out of the mixing chamber 120. The initial amount of the mixture is stored in the reservoir 140 until the mixer 100 is discarded, although some small amount of the mixture in the reservoir could be mixed within the chamber 120.

Figure 2:
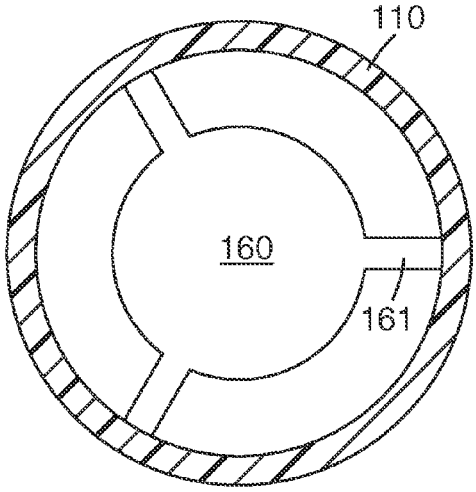
FIG. 2 is a top view of the baffle plate of the mixer of FIG. 1.

The attachment of the baffle plate 160 is shown in more detail in FIG. 2. The circular plate 160 comprises at least one connection 161. In the embodiment shown in FIG. 2, three connections 161 are provided. The three connections are spaced from each other at an angle of 120°. With these three connections 161, the baffle plate 160 is connected to the wall of the housing 110. Other acceptable numbers or ways of connecting a baffle plate to the wall of the housing can be designed.

Figure 3:
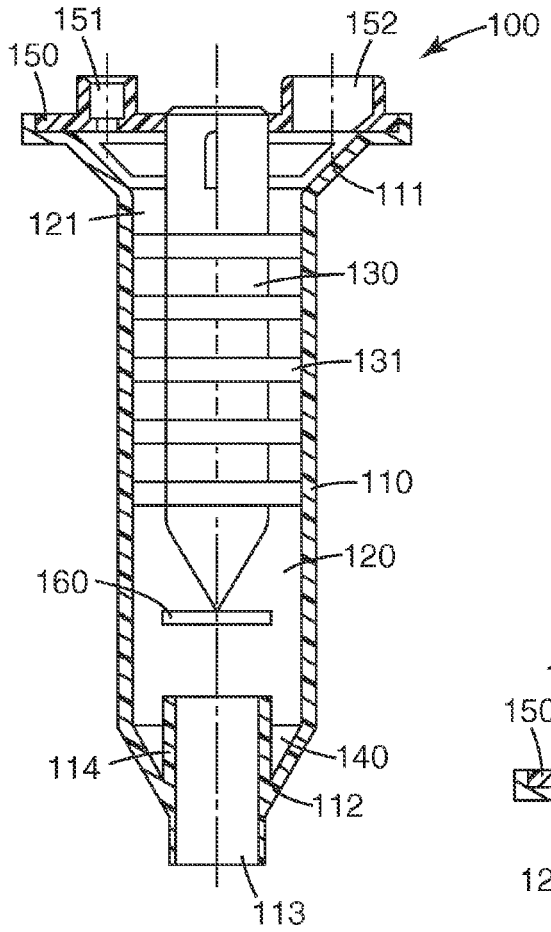
FIG. 3 is a longitudinal view of a second embodiment of the mixer according to the first aspect of the present invention.

FIG. 3 shows a longitudinal view of a second embodiment of the mixer 100 of the first aspect of the present invention. This second embodiment of the first aspect is substantially identical to the first embodiment shown in FIG. 1. However, in this embodiment, the baffle plate is not located in the space between the tip of the mixing element 130 and the tubular element 114. Rather, the baffle plate 160 is connected to the tip of the mixing element 130 or forms an integral part thereof. This embodiment is advantageous in comparison to the embodiment of FIG. 1 because there are no projections in the space between the baffle plate 160 and the wall of the housing 110 which would resist the flow of the mixture.

Figure 4:
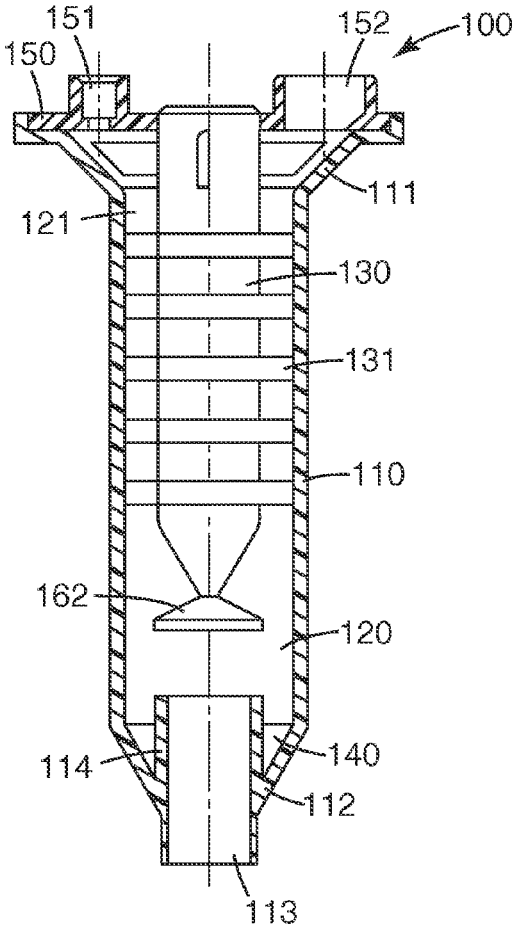
FIG. 4 is a longitudinal view of a third embodiment of the mixer according to the first aspect of the present invention.

Another alternative is shown in FIG. 4. FIG. 4 is a longitudinal view of the third embodiment of the mixer 100 according to the first aspect of the present invention. Like in FIG. 3, in FIG. 4 a baffle 162 is connected to the tip of the mixing element 130. However, in this embodiment, the baffle is in the form of a cone or truncated cone 162. As can bee seen in FIG. 4, the truncated cone 162 is connected with its "tip" to the mixing element such that the diameter of the baffle cone 162 is increasing in the downstream direction of the mixture flow. This slope, on the one hand, provides the necessary deflection of the flow of the mixture so that the initial amount of the mixture reaches the reservoir 140. On the other hand, due to the slope the axial forces acting on the baffle 162 are reduced.

Figure 5:
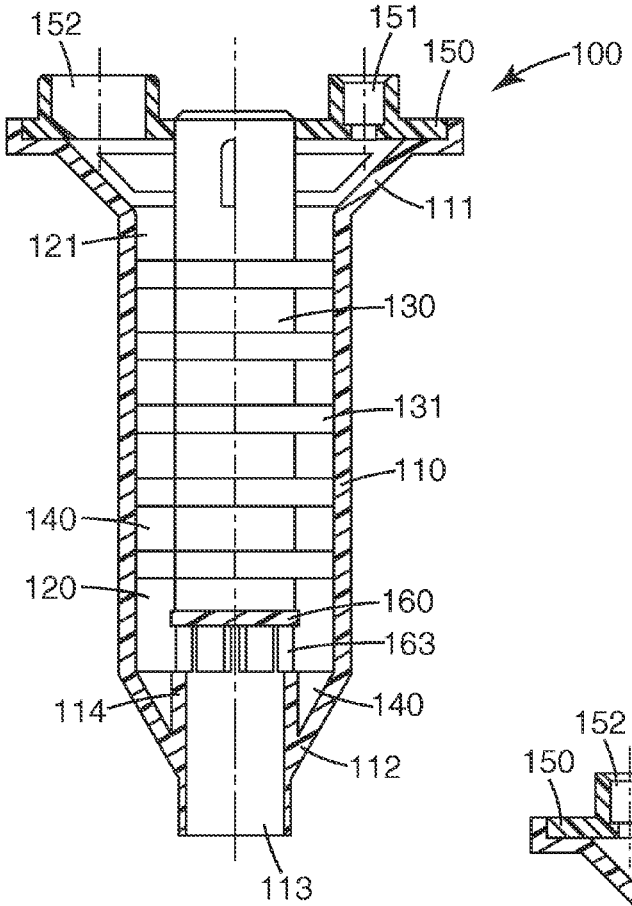
FIG. 5 is a longitudinal view of a fourth embodiment of the mixer according to the first aspect of the present invention.
Figure 6:
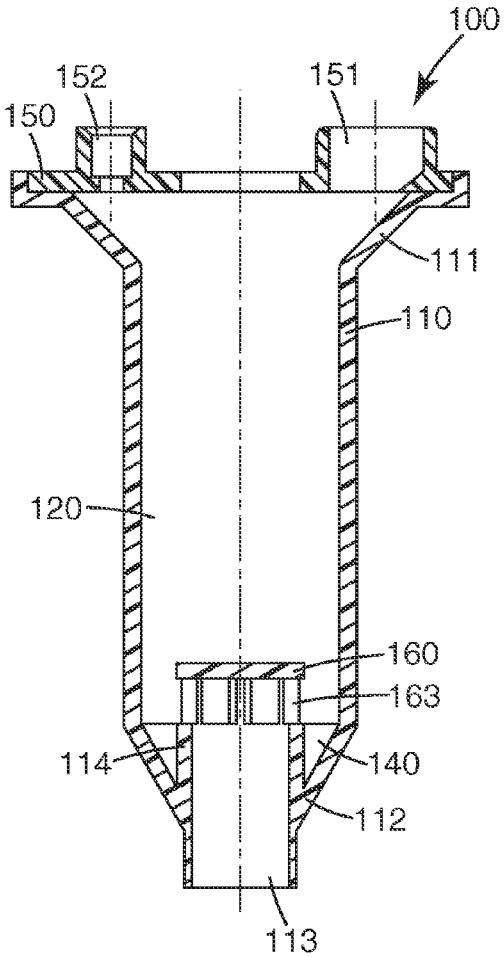
FIG. 6 is a longitudinal view of the fourth embodiment of the mixer shown in FIG. 5, without the mixing element.

FIG. 5 shows a longitudinal view of a fourth embodiment of the mixer 100 according to the first aspect of the present invention. In this embodiment, again a baffle plate 160 is provided. However, in contrast to what is shown in FIGS. 1 and 2, the baffle plate 160 of FIG. 5 is connected to and supported by the tubular element 114. FIG. 5 shows a plurality of connections or post(s) 163 that extend from the rear end of the tubular element 114 to support the baffle plate 160. Between these posts 163, passageways are formed that allow the mixture to flow to the discharge opening 113 once the annular reservoir 140 is filled. The front end of the mixing element 130 contacts the upper surface of the baffle plate 160 so that the flow of the mixture is guided into the reservoir 140. Once the reservoir 140 is filled, the flow of the mixture is re-directed to the centre of the mixer and then out of the discharge opening 113. FIG. 6 also shows the embodiment of FIG. 5, however, without the mixing element.

Figure 7:
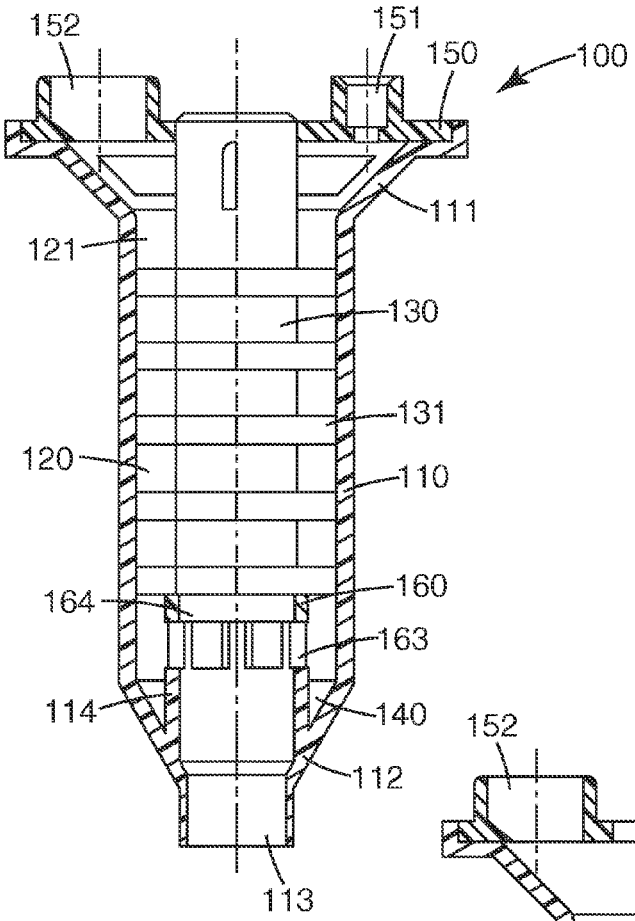
FIG. 7 is a longitudinal view of a fifth embodiment of the mixer according to the first aspect of the present invention.
Figure 8:
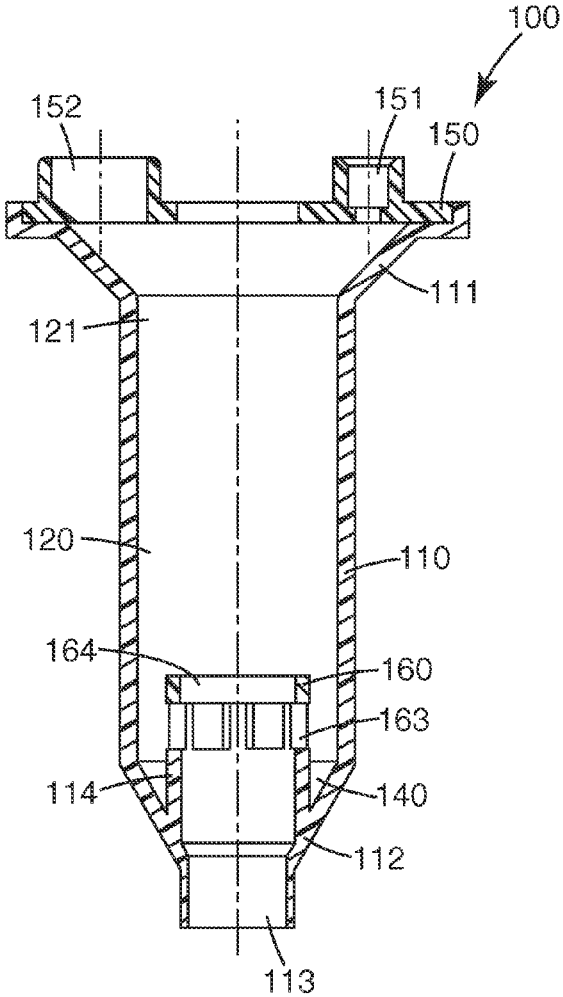
FIG. 8 is a longitudinal view of the fifth embodiment of the mixer shown in FIG. 7, without the mixing element.

In the longitudinal view of FIG. 7, which shows a fifth embodiment of the mixer 100 of the first aspect of the present invention, a modified baffle plate 160 can be seen. Again, baffle plate 160 is supported by the tubular element 114 by means of posts 163 forming passageways therebetween. However, in contrast to the embodiment of FIG. 5, the baffle plate 160 comprises a recess or socket 164. This recess 164 is adapted to receive the front end of the mixing element 130. Thus, the baffle plate 160 with its recess 164 forms a front end bearing-like or socket-like structure for the mixing element. This provides better stability for the mixer 100. FIG. 8 shows the same embodiment, however, without the mixing element.

Figure 9:
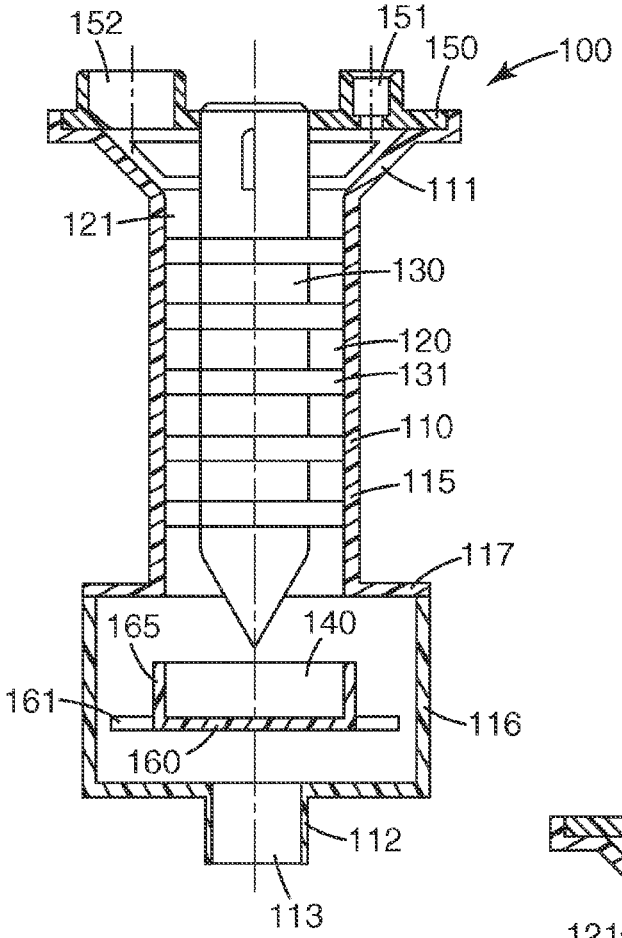
FIG. 9 is a longitudinal view of a sixth embodiment of the mixer according to the first aspect of the present invention.

FIG. 9 is a longitudinal view of a sixth embodiment of the mixer 100 according to the first aspect of the present invention. Like in FIGS. 1 through 8, the reservoir is formed at the front end of the mixer. Furthermore, the reservoir is formed such that it is fillable in an axial direction, i.e., along the longitudinal axis. In this embodiment, the baffle is formed by a baffle plate 160 which comprises one or more connections 161 to support the baffle plate at the wall of the housing 110. Furthermore, baffle plate 160 comprises a tubular wall 165 that extends from the plate along the longitudinal axis of the mixer, and towards the rear end of the housing 110. Thus, a cavity or trough forms the reservoir 140. As can be easily seen in FIG. 9, the initial amount of mixture that comes from the mixing element is received in the reservoir 140. When the reservoir 140 is full, the flow of the mixture is deflected so that the mixture flows around the baffle plate 160 towards the discharge opening 113.

As an alternative to the connections 161 connecting the baffle plate to the wall of the housing, support webs are provided similar to those shown, e.g. in FIG. 7.

Preferably, in this embodiment, the housing does not have a constant cross-section along the entire length. Rather, the housing comprises a first section 115 having a first diameter, and a second section 116 having a second diameter. The second diameter is greater than the first diameter. The baffle member 160 is provided in the second section 116. The two sections 115 and 116 are connected by means of flange 117. In case the housing has such two sections 115 and 116, it is preferable that the tubular element 165 of the baffle has a diameter that corresponds to the diameter of the first section 115 of the housing. This geometrical configuration ensures that the first amount of mixture is received in the reservoir 140 since the tubular element 150 is aligned with the first section 115 of the housing 110.

Figure 10:
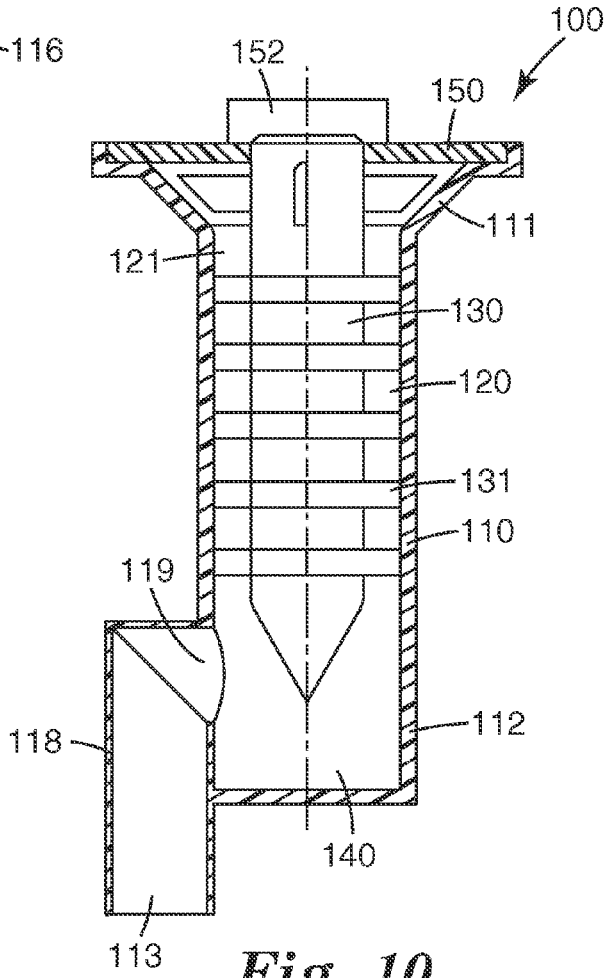
FIG. 10 is a longitudinal view of a seventh embodiment of the mixer according to the first aspect of the present invention.

FIG. 10 is a longitudinal view of a seventh embodiment of the mixer according to the first aspect of the present invention. Also in this embodiment, the reservoir is filled in the longitudinal direction of the flow of the mixture. In the embodiment shown in FIG. 10, the discharge opening 113 is not provided in line with the longitudinal axis of the mixer. Rather, the mixer is closed at this end. However, the housing 110 comprises a wall opening 119 in the circumferential wall of the housing. The wall opening 119 is located in the front end area 112 of the housing 110 and also offset from the front end wall of the housing 110. In detail, the wall opening 119 is offset towards the front end 112 of the housing 110 such that a cavity or trough is formed between the wall opening 119 and the front end wall of the housing 110. Furthermore, a deviating channel 118 extends from the wall opening 119 and terminates in the discharge opening 113. Thus, the discharge opening 113 is offset from the longitudinal axis of the mixer 100. The deviating channel 118 may have different forms. In the preferred embodiment shown in FIG. 10, the deviating channel 118 comprises a right angle so that the mixture is first directed through the wall opening 119 transverse to the longitudinal axis of the mixer, and then redirected in a direction parallel to the longitudinal axis of the mixer 100. Alternatively, the channel axis is inclined to the axis of the mixer. As can be seen in FIG. 10, the mixture enters the deviating channel 118 after the reservoir 140 is filled.

Figure 11:
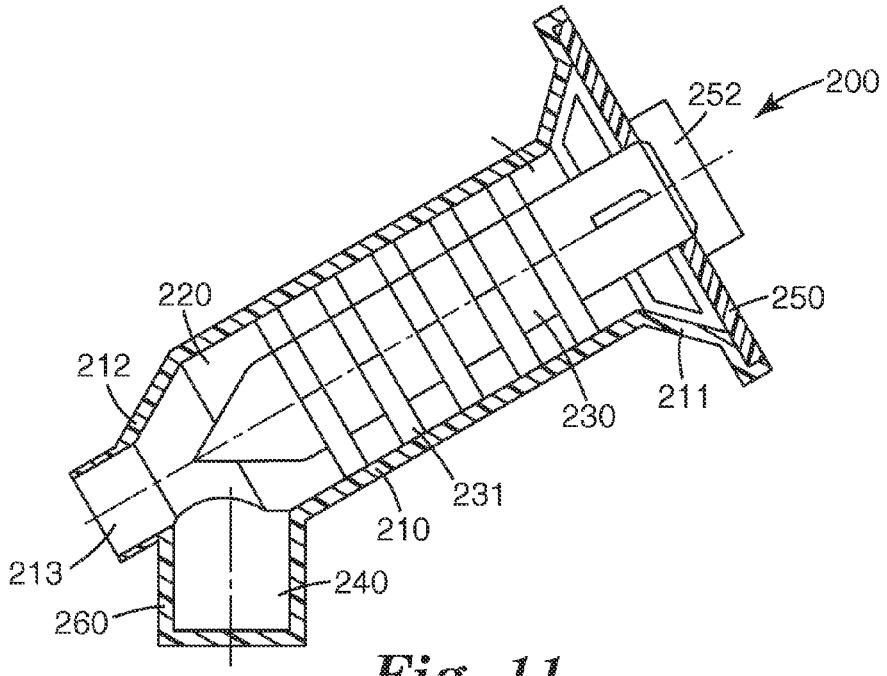
FIG. 11 is a longitudinal view of an embodiment of the mixer according to a second aspect of the present invention, having a reservoir at the front end of the mixer and using gravitational forces.

FIG. 11 shows a first embodiment of the mixer 200 according to a second aspect of the present invention. According to the second aspect of the present invention, the mixer uses gravitational forces to fill the reservoir. In the preferred embodiment shown in FIG. 11, the reservoir 240 is formed at the front end 212 of the mixer 200.

Mixer 200 comprises a housing 210 with a front end 212 and a rear end 211. The housing furthermore forms a mixing chamber 220 having an entry side 221 adjacent to a terminating plate 250. Like in the embodiments shown in FIGS. 1-10, terminating plate 250 comprises inlet pipes. In FIG. 11, inlet pipe 252 only is shown. In the mixing chamber 220, mixing element 230 with mixing vanes 231 is provided.

At the front end 212 of the housing 210, there is provided a discharge opening 213. Furthermore, the front end 212 of the housing 210 comprises a closed channel 260. The closed channel 260 forms a cavity or trough, forming the reservoir 240. As shown in FIG. 11, the closed channel 260 comprises an axis, and the axis of the closed channel 260 is inclined relative to the longitudinal axis of the mixer 200. FIG. 11 shows the typical position of the mixer during use. Thus, the mixer is typically inclined during use. This typical inclination is taken into account for the inclination of the axis of the closed channel relative to the longitudinal axis of the mixer. Thus, the axis of the closed channel is inclined relative to the longitudinal axis of the mixer such that the axis of the closed channel is vertical when the mixer is in its typical dispensing position. The first amount of mixture thus flows into the reservoir 240 due to the gravitational forces. When the reservoir 240 is filled, the mixture flows out of the discharge opening 213.

Figure 12:
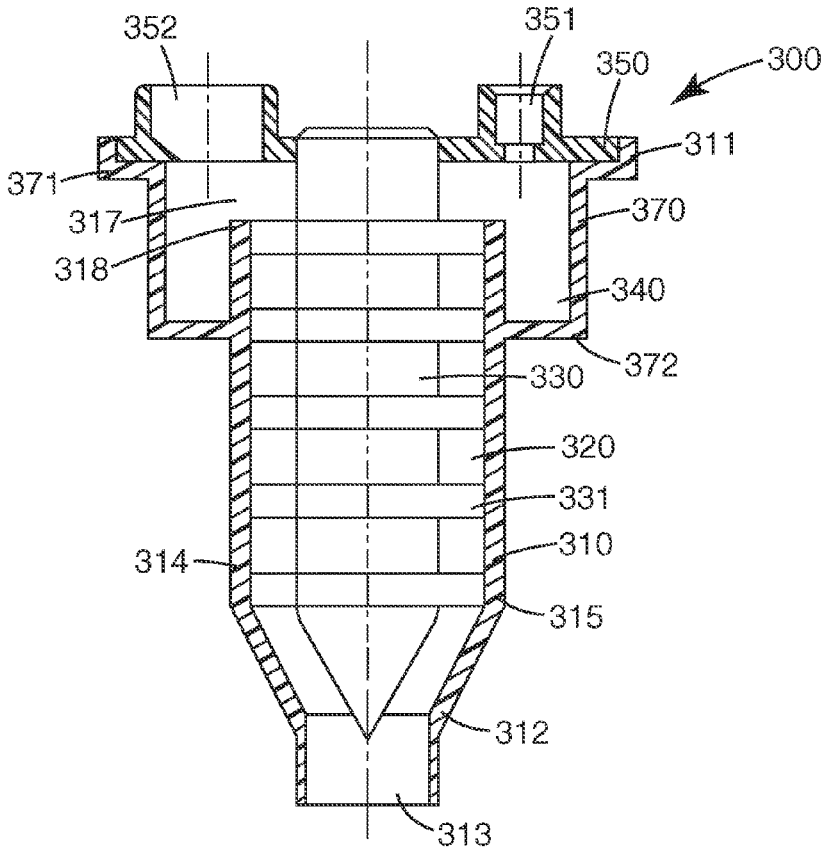
FIG. 12 is a longitudinal view of an embodiment of the mixer according to a third aspect of the present invention, having a reservoir at the rear end of the mixer.

FIG. 12 is a longitudinal view of a first embodiment of the mixer according to a third aspect of the present invention. According to the third aspect of the present invention, the reservoir is provided at the rear end of the mixer, and is Tillable in an axial direction.

The mixer 300 shown in FIG. 12 comprises a housing 310 with a rear end 311 and a front end 312. A discharge opening 313 is provided at the front end 312. The housing 310 furthermore provides a mixing chamber 320. In the mixing chamber 320, a mixing element 330 with mixing blades or vanes 331 is provided. The housing 310 is closed at its rear end with terminating plate 350. FIG. 12 shows inlet pipes 351 and 352.

The housing 310 according to this embodiment comprises a main section 314. The main section 314 has a first diameter along its length and a first front end 315 and a first rear end 318. Furthermore, housing 310 of the mixer 300 of this embodiment comprises a second section 370 having a second rear end 371 and a second front end 372. The diameter of the second section 370 is greater than the first diameter of the main section 314 at least at the second rear end 371. The second rear end 371 of the second section 370 forms the rear end 311 of the housing 310. Furthermore, the first rear end 318 is inwardly offset along the longitudinal axis of the mixer 300 from the rear end 311 of the housing 310. Thus, a passage 317 is formed between the terminating plate 350 and the first rear end 318 of the main section 314. The second front end 372 of the second section 370 is connected to the main section 314 in a circumferential area which is offset from the first rear end 318 towards the first front end 315 of the main section 314. Due to this offset connection between the second section and the main section, a reservoir 340 is formed. In particular, in the embodiment shown in FIG. 12, the reservoir 340 is annular and surrounds the rear end 318 of the main section 314 along a certain longitudinal length.

In the preferred embodiment shown in FIG. 12, the second section comprises a stepped configuration, i.e. the second section comprises a certain length having a constant diameter, and is then connected to the main section by means of a flange 372. However, alternative designs are also possible. For example, the second section 370 may have the form of a truncated cone with its diameter increasing from the main section towards the terminating plate.

A mixer having a reservoir at the rear end of the housing stores the initial amount of the components that enter the mixing chamber. For example, in the embodiment shown in FIG. 12, the diameters of the main section and the second section of the housing are such that the reservoir 340 is provided underneath inlet pipes 351, 352. Thus, the initial amount of components entering the mixer through inlet pipes 351 and 352 axially flows into the reservoir 340. This provides that only a balanced amount of the components finally enters the mixing chamber 320 so that a mixture having a desired mixing ratio is prepared. Thus, the present invention encompasses a mixer in which either a portion of the mixed material can be diverted, or portions of each of the unmixed material can be diverted individually (either to separate reservoirs or to a single reservoir).

Figure 13:
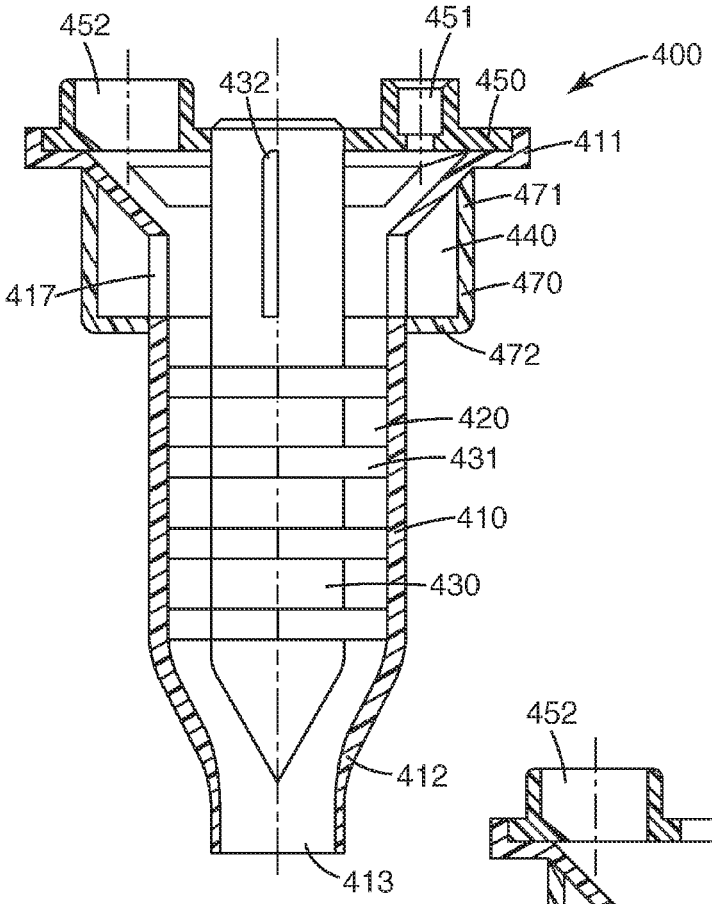
FIG. 13 is a longitudinal view of a first embodiment of the mixer according to a fourth aspect of the present invention, having a reservoir at the rear end of the mixer.

In the embodiment shown in FIG. 13, the reservoir is also formed at the rear end of the housing. However, FIG. 13 is a preferred embodiment of a fourth aspect of the present invention. According to the fourth aspect of the present invention, the reservoir is not filled in an axial direction but rather in a radial direction.

The mixer 400 shown in FIG. 13 comprises a housing 410 having a rear end 411 and a front end 412. Discharge opening 413 is provided at the front end 412. In the mixing chamber 420, a mixing element 430 with mixing vanes 431 is provided. The housing 410 is closed by the terminating plate 450 having inlet pipes 451 and 452.

In the embodiment shown in FIG. 13, the housing again comprises a main section having a first diameter and a second section 470 having a second, greater diameter. The second section 470 has a rear end 471 and a front end 472. In the embodiment shown in FIG. 13, the housing comprises at least one passageway 417 through its circumferential wall. Preferably, a plurality of passageways 417 are provided. The second section 470 forms a wall structure that forms a cavity covering the at least one passageway on the outer surface of the housing. Thus, a reservoir 440 is formed. In the preferred embodiment of FIG. 13, the wall structure annularly surrounds the housing 410.

Furthermore, the shaft of the mixing element 430 comprises at least one paddle 432 that pushes the initial amount of the components radially into the reservoir 440 as the mixing element rotates.

Figure 14:
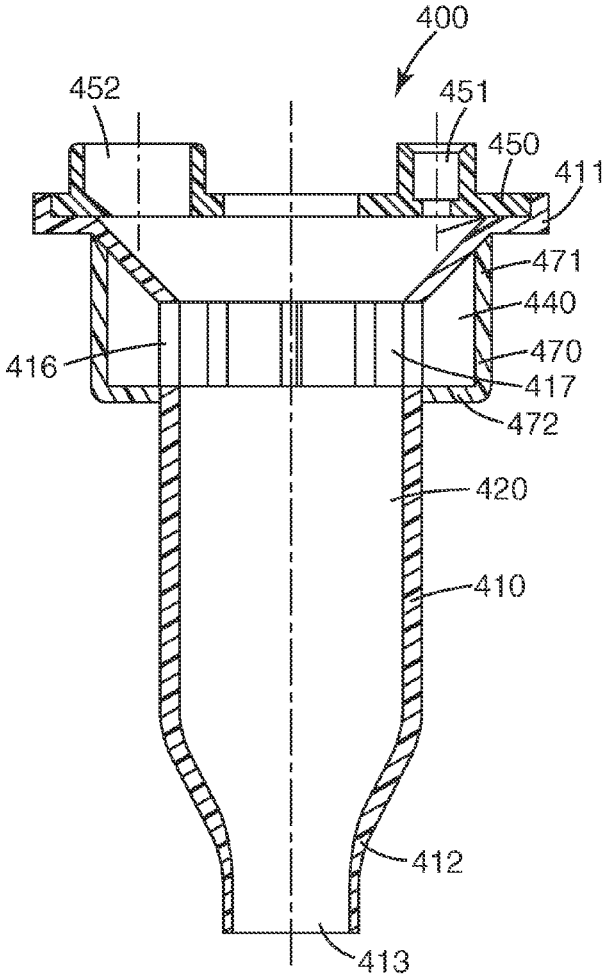
FIG. 14 is a longitudinal view of the first embodiment of the mixer according to the fourth aspect of the present invention shown in FIG. 13, without the mixing element.

FIG. 14 shows the embodiment of FIG. 13 without the mixing element 430 so that the plurality of passageways 417 formed between posts or webs 416 can be seen more clearly.

Figure 15:
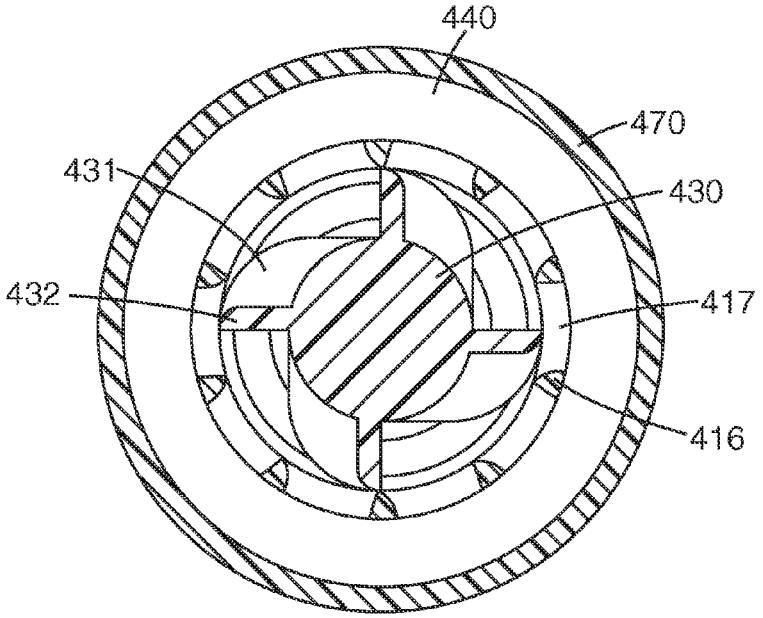
FIG. 15 shows a cross-sectional view of the reservoir of the mixer of FIG. 13.

FIG. 15 shows a cross-sectional view of the reservoir of the mixer 400 of FIG. 15. FIG. 15 particularly shows the mixing element 430 with mixing vanes 431 and the paddles 432. The annular reservoir 440 is formed within wall structure 470, and the first amounts of the components enter the reservoir 440 through the passageways 427 formed between posts 416.

Figure 16:
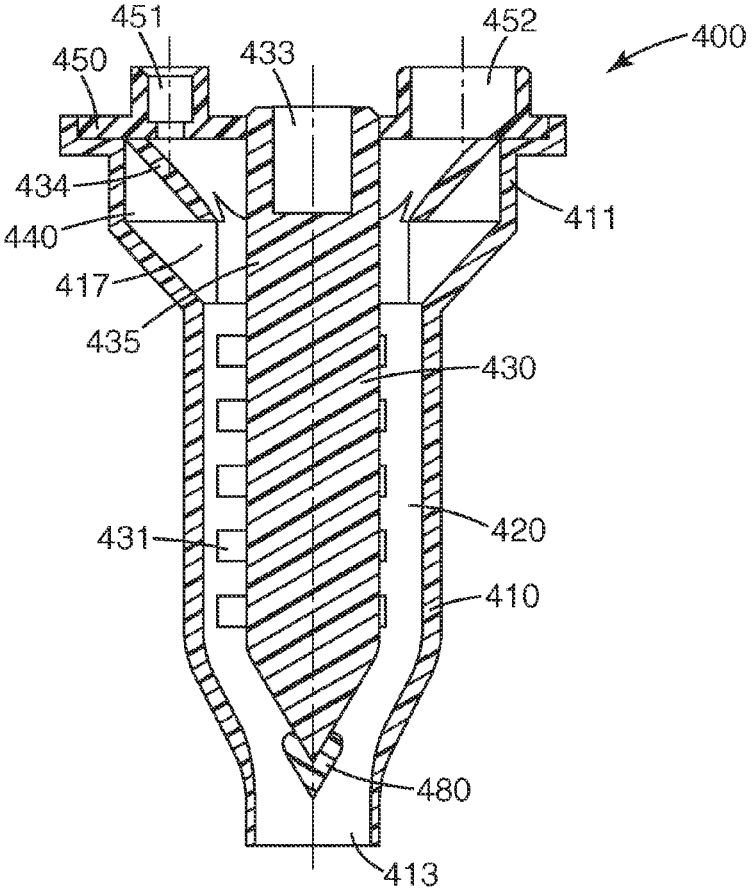
FIG. 16 is a longitudinal view of a second embodiment of the mixer according to the fourth aspect of the present invention, having a reservoir at the rear end of the mixer.

A second embodiment of the fourth aspect of the present invention is shown in FIG. 16. Here, the housing 410 comprises a main section having a first diameter and an area of increasing diameter between said main section and the rear end 411 of the housing 410. Furthermore, the mixing element 430 comprises a funnel-shaped element 434. This funnel-shaped element 434 is arranged at the rear end of the mixing element 430, and also rearwards of the main housing section. Thus, the funnel-shaped element is provided within the area of the housing having the increasing diameter. The diameter of the funnel-shaped element 434 decreases from its rearmost end to the other end where it is connected to the shaft of the mixing element 430. Thus, the funnel-shaped element 434 rotates with the mixing element 430. In order to allow flow of the components towards the mixing chamber 420, the funnel-shaped element 434 comprises at least one passageway at its front end. The at least one passageway allows flow of the components along the longitudinal axis of the mixer 400. On the other hand, at its rear end, the funnel-shaped element 434 defines an opening having a diameter such that the components enter the mixer within the opening of the funnel-shaped element 434.

As can be seen in FIG. 16, the connection between the funnel-shaped element 434 and the shaft of the mixing element 430 is located rearwards from the rear end of the main section of the housing 410. Thus, a cavity is formed between the funnel-shaped element 434 and the area of the housing 410 having the increased diameter. This cavity forms the reservoir 440. Since the rear end of the main section of the housing is offset from the funnel-shaped element 434, at least one passageway 417 is formed through which the initial amount of the components to be mixed enters the reservoir 440.

FIG. 16 also shows the hexagonal recess 433 and the rear end of the shaft 435 of the mixing element 430 for driving the mixing element.

Furthermore, at the front end of the mixing element 430, a bearing-like structure or socket 480 is provided in order to cope with the axial forces acting on the mixing element 430 due to the provision of the funnel-shaped element 434 at the rear end of the mixing element.

Figure 17:
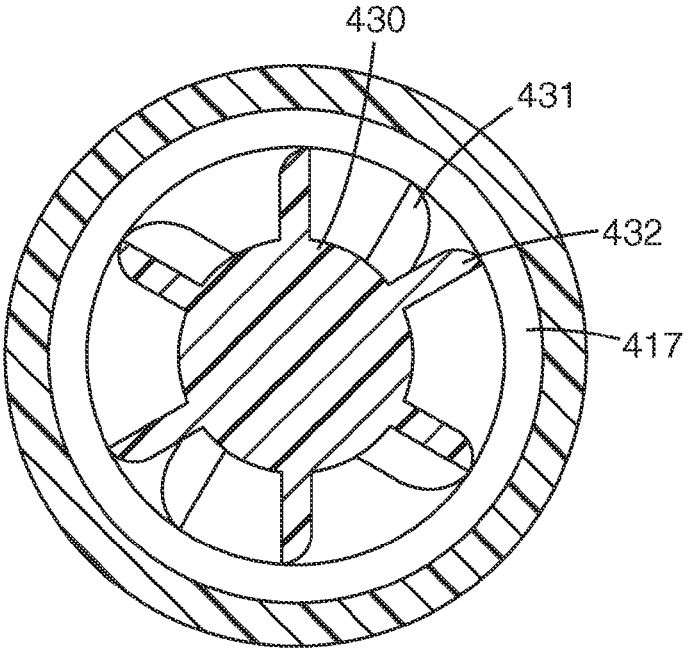
FIG. 17 is a cross-sectional view through the paddles of the mixer of FIG. 16.

FIG. 17 shows a cross-sectional view through the paddles 432 of the mixer 400 of FIG. 16. FIG. 17 shows the mixing element 430 comprising six paddles 432 and four mixing vanes 431 (as can be seen in FIG. 16, a sequence of mixing vanes 431 is provided). Furthermore, FIG. 17 shows a passageway 417 into reservoir 440.

Figure 18:
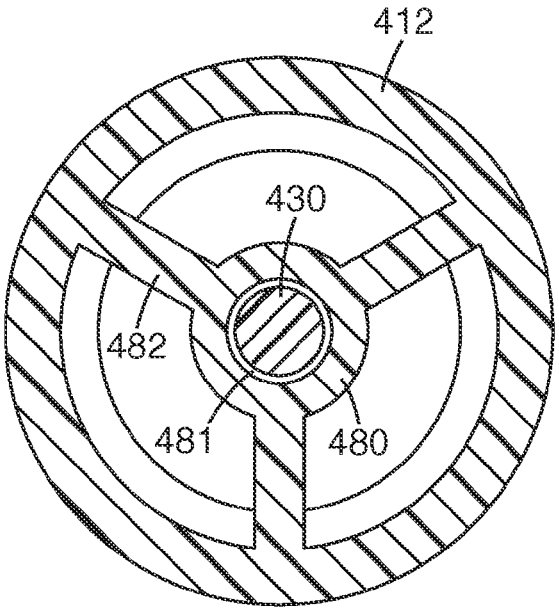
FIG. 18 is a cross-sectional view through the bearing pin of the mixer of FIG. 16.

FIG. 18 shows a cross-sectional view through the socket 480 for the front end of the mixing element 430. The socket 480 has an annular form so that a through-hole 481 is formed. This through-hole 481 receives the front end of the mixing element 430. The annular socket 480 is connected to the wall of the front end 412 of the housing by means of at least one, preferably three, connections 482.

Figure 19:
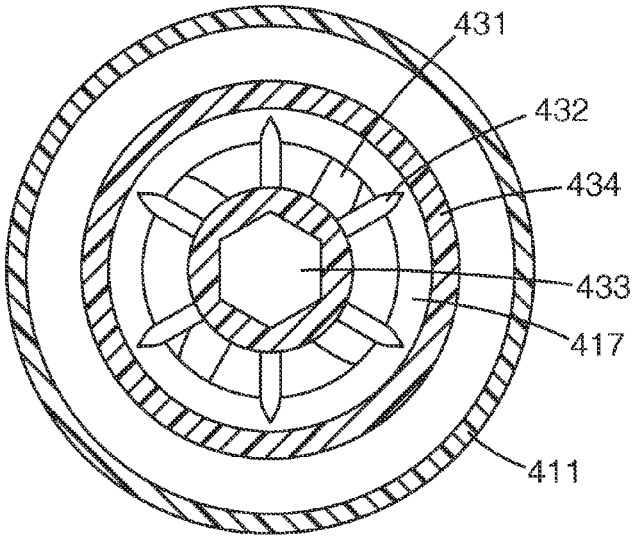
FIG. 19 is a cross-sectional view through the inlet funnel of the mixer of FIG. 16.

FIG. 19 shows a cross-sectional view through the inlet funnel of the mixer 400. FIG. 19 shows the hexagonal recess 433 for the drive shaft. Furthermore, the paddles 432 and the mixing vanes 431 are shown. FIG. 19 also shows the rear end 411 of the housing that provides the cavity, i.e. reservoir 440 as well as the funnel-shaped element 434. FIG. 19 also shows the passageway 417 into the reservoir.

Figure 20:
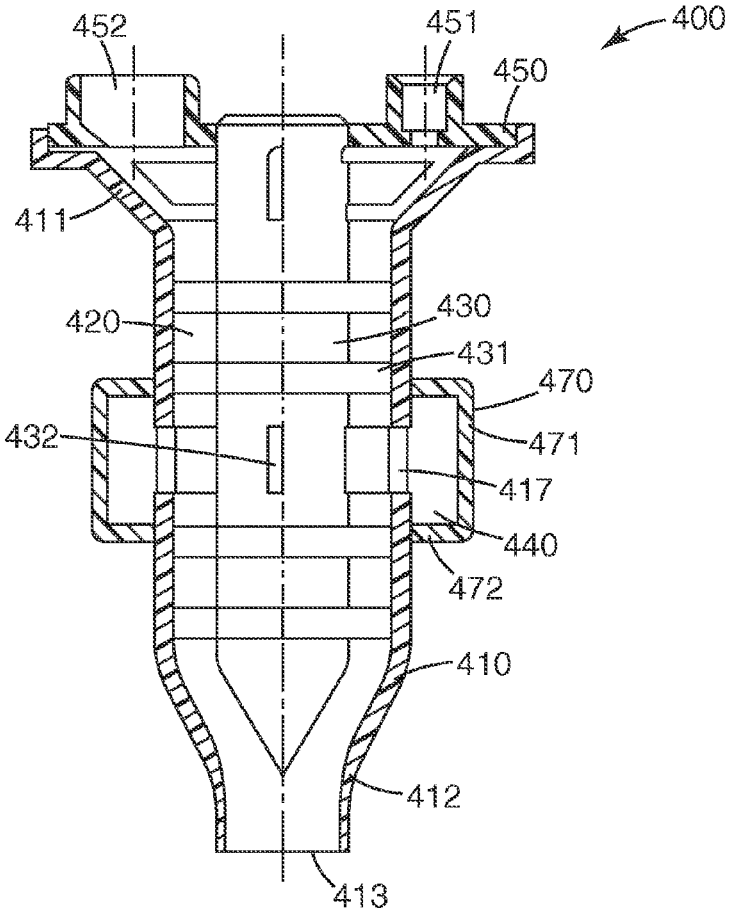
FIG. 20 is a longitudinal view of a first embodiment of the mixer according to a fifth aspect of the present invention, having a reservoir at the middle of the mixer.

FIG. 20 shows a first embodiment of the mixer 400 according to the fifth aspect of the present invention. According to the fifth aspect of the present invention, radial forces are used to fill the reservoir 440. However, in this aspect of the present invention, the reservoir is formed in an area in the middle of the mixer 400. In this embodiment, the housing 410 comprises a plurality of passageways 417 to the outside. However, these passageways 417 are covered by a wall structure 470 that forms a cavity, i.e. reservoir 440. In the embodiment of FIG. 20, the wall structure 470 annularly surrounds the housing 410 of the mixer 400 so that an annular reservoir 440 is provided. According to FIG. 20, the wall structure comprises a U-shaped form having a tubular section 471 and flange sections 472 that form the legs of the U. At the same level of the passageways 417, the shaft of the mixing element 430 comprises paddles 432 that press the initial amount of the mixture into the reservoir 440. Thus, according to the fifth aspect of the present invention, it is again the first amount of the mixture that is stored in the reservoir.

Figure 21:
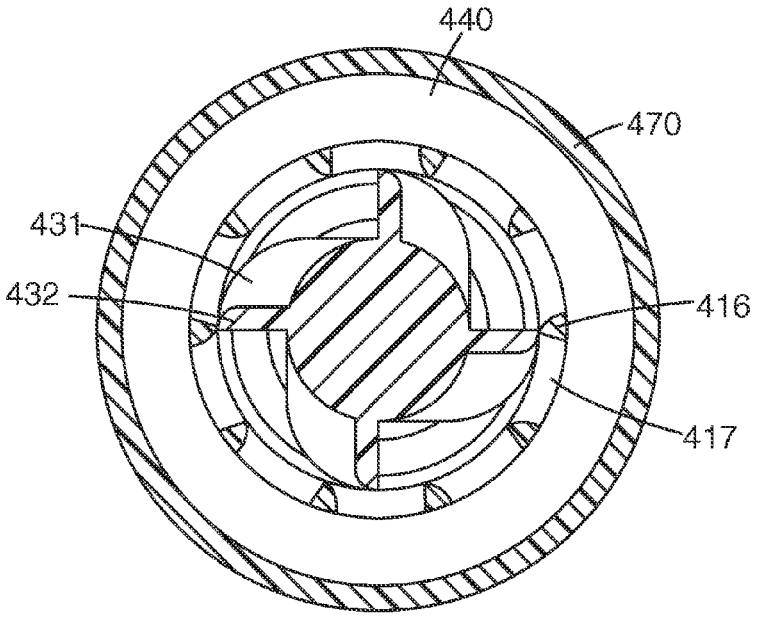
FIG. 21 is a cross-sectional view of the reservoir of the mixer of FIG. 20.

A cross-sectional view at the level of the passageways of the embodiment of FIG. 20 is shown in FIG. 21.

A sixth aspect of the present invention is shown in FIGS. 22-25. According to this aspect of the present invention, the reservoir is provided within the mixing element.

The mixer 500 according to the sixth aspect of the present invention comprises a housing 510 with a rear end 511 and a front end 512 with discharge openings 513. Terminating plate 550 with inlet pipes 551 and 552 closes the housing 510 at the rear end thereof. A mixing element 530 is provided in the mixing chamber 520. The mixing element comprises mixing vanes 533 as well as a reservoir 540. Thus, the shaft of the mixing element 530 is hollow. One or more passageways 517 are provided at the rear end of the shaft 535 of the mixing element 530. Thus, the initial amount of the components flow into the hollow cavity of the mixing element before the mixing chamber 520 is contaminated.

Figure 22:
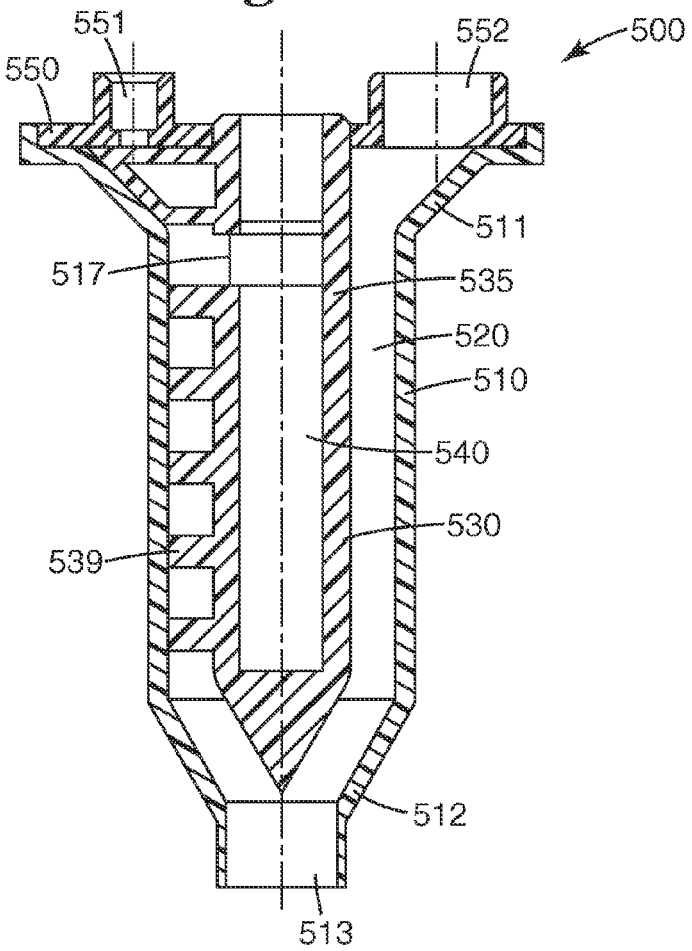
FIG. 22 is a longitudinal view of a first embodiment of the mixer according to a sixth aspect of the present invention, having a reservoir within the mandrel of the mixing element of the mixer.
Figure 23:
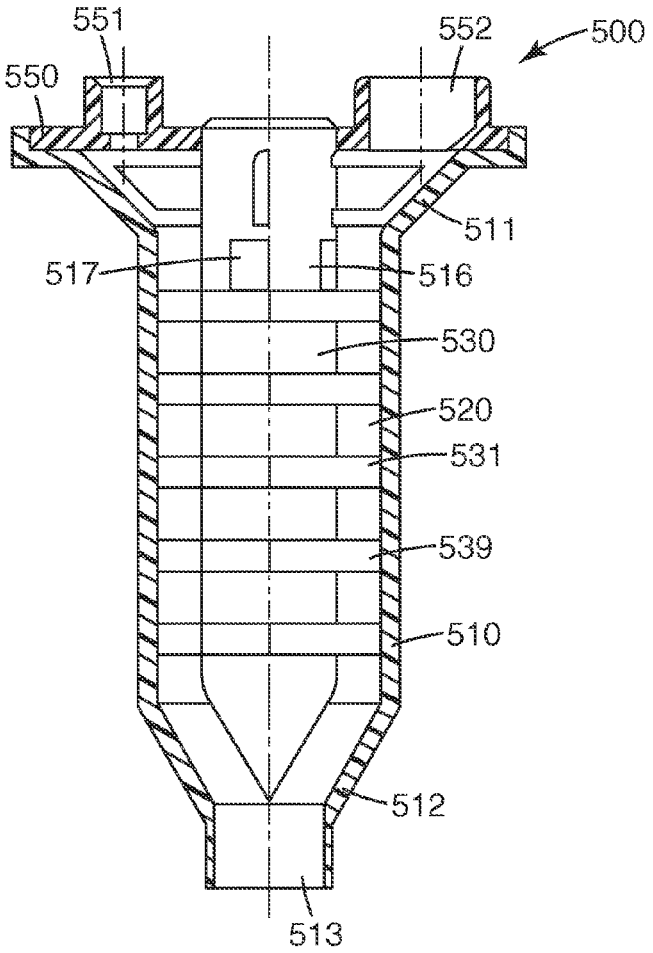
FIG. 23 is a longitudinal view of the mixer of FIG. 22 with the mixing element.

FIG. 23 shows a different view of the embodiment of FIG. 22. In FIG. 23, the passageways 517 and the wall elements 516 located in between are clearly shown.

Figure 24:
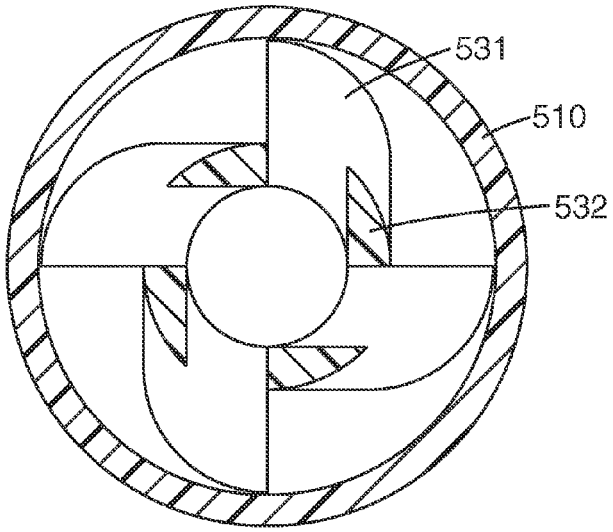
FIG. 24 is a cross-sectional view of the mixer of FIG. 22.

A cross-sectional view of the mixer of FIG. 22 is shown in FIG. 24. FIG. 24 shows the mixing vanes 531 as well as the paddles 532 that cause a deflection of the flow of the components into the reservoir 540.

Figure 25:
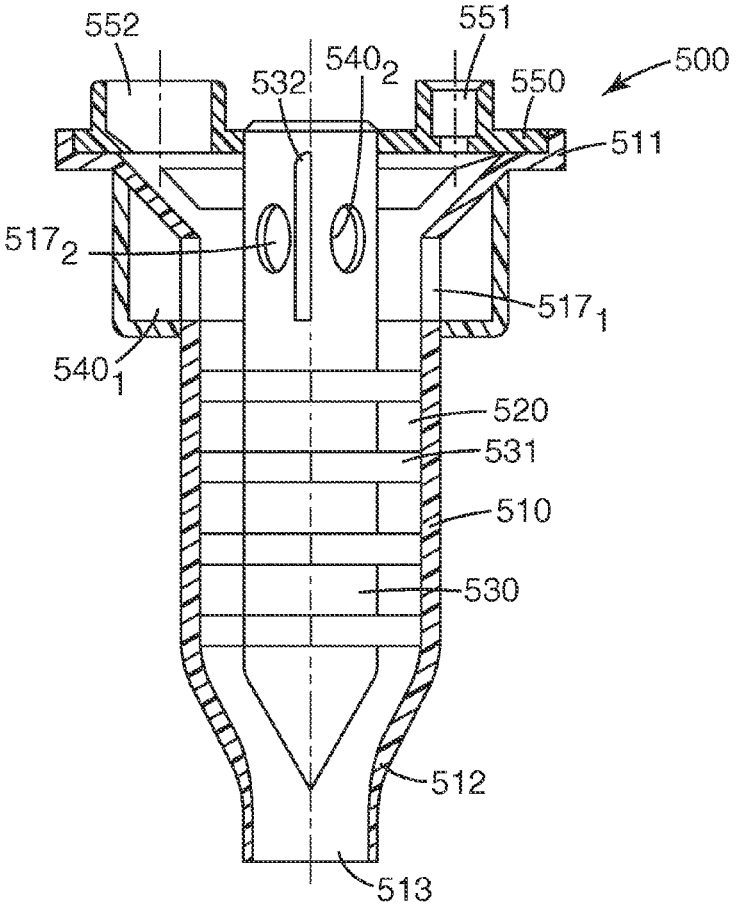
FIG. 25 is a longitudinal view of a second embodiment of the sixth aspect of the present invention.

A second embodiment of the sixth aspect of the present invention is shown in FIG. 25. In this embodiment, the shaft 535 of the mixing element 530 comprises circular or elliptical openings 517*b* at the rear end of the shaft 535 so that the initial amount of the components are directed into the reservoir 540*b* within the shaft 535. However, according to this aspect of the present invention, a second reservoir 540*a* is formed which is identical to the reservoir 440 shown in FIG. 13. Passageways 517*a* are provided so that the reservoir 540*a* is filled with the initial amount of the components to be mixed.

Figure 26:
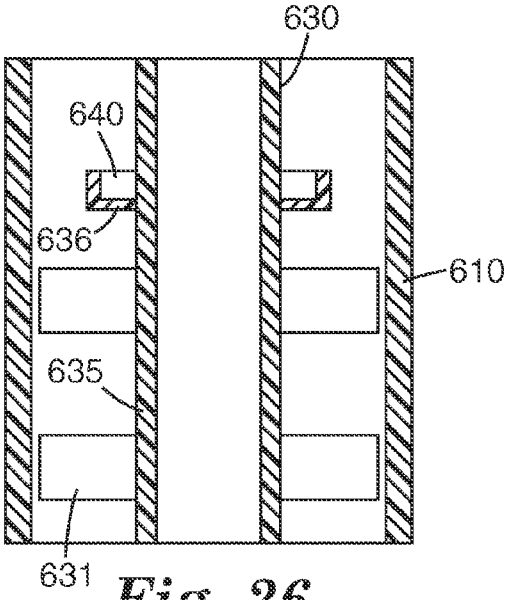
FIG. 26 is a longitudinal view of a first embodiment of a seventh aspect of the present invention.

FIG. 26 shows a seventh aspect of the present invention, a mixing element 630 is provided within the housing 610. The mixing element 630 comprises mixing vanes 631. Furthermore, the mixing element comprises a rearwardly directed L-shaped circumferential flange 636. This L-shaped flange 636 forms an annular reservoir 640. In order to store the initial amount of the components to be mixed, the L-shaped flange 636 is located at the rear end of the mixing element.

The invention claimed is:

1. A mixer, comprising a housing having a longitudinal axis, a rear end, a wall and a front end with a discharge opening;

a mixing chamber in the housing and having an entry side facing the rear end of the housing; and a reservoir having an entrance upstream of the discharge opening and being capable of permanently storing an initial amount of components for forming a mixture in the mixing chamber, wherein the initial amount of the components remain in the reservoir while a subsequent content of the mixing chamber is dispensed from the discharge opening, wherein the housing further comprises a tubular element projecting from the discharge opening inwards into the mixing chamber and the reservoir is formed between the tubular element and the wall of the housing.

2. The mixer of claim 1, wherein the mixer is configured such that when the initial amount fills the reservoir, the subsequent content of the mixing chamber is extrudable through the discharge opening.

3. The mixer of claim 1, wherein the rear end of the housing is formed by a terminating plate, comprising separate inlet pipes for connection with a dispensing cartridge containing components.

4. The mixer of claim 1, further comprising a mixing element in the mixing chamber.

5. The mixer of claim 4, further comprising a baffle downstream of a front end of the mixing element.

6. The mixer of claim 5, wherein the baffle is connected to the front end of the mixing element.

7. The mixer of claim 5, wherein the baffle comprises a circular plate in a plane transverse to the longitudinal axis and the initial amount fills at least one connection for connecting the plate to the wall of the housing.

8. The mixer of claim 5, the housing comprising a tubular element projecting from the discharge opening inwards into the mixing chamber, wherein the baffle comprises a circular plate in a plane transverse to the longitudinal axis and at least one connection for connecting the plate to the tubular element.

9. The mixer of claim 8, wherein the plate comprises a recess for the front end of the mixing element.

10. The mixer of claim 4, further comprising a baffle located between the mixing element and the front end of the housing, the baffle comprising a circular plate in a plane transverse to the longitudinal axis and at least one connection for connecting the plate to the wall of the housing, the baffle further comprising a tubular wall extending from the plate along the longitudinal axis towards the rear end of the housing.

* * * * *